US005770072A

United States Patent [19]

Grönvold-Hansen et al.

[11] Patent Number: 5,770,072

[45] Date of Patent: Jun. 23, 1998

[54] MULTIPLE INLET VALVE WITH MEANS TO ISOLATE EACH INLET INDIVIDUALLY AND DIRECT A REVERSE FLOW THERETHROUGH

[75] Inventors: Christen Grönvold-Hansen, Karlstad; Stig Eriksson, Skoghall, both of Sweden

[73] Assignee: Kvaerner Pulping AB, Sweden

[21] Appl. No.: 693,162

[22] PCT Filed: Jan. 24, 1995

[86] PCT No.: PCT/SE95/00062

§ 371 Date: Aug. 14, 1996

§ 102(e) Date: Aug. 14, 1996

[87] PCT Pub. No.: WO95/22708

PCT Pub. Date: Aug. 24, 1995

[30] Foreign Application Priority Data

Feb. 18, 1994 [SE] Sweden ..... 9400550

[51] Int. Cl.[6] ..... B01D 29/00

[52] U.S. Cl. ..... 210/333.01; 210/333.1; 210/340; 162/233; 162/251; 137/607; 137/876; 137/545; 137/266

[58] Field of Search ..... 210/332, 333.01, 210/333.1, 334, 340, 341, 418, 420; 137/602, 607, 876, 549, 263, 266, 550, 545; 162/233, 251

[56] References Cited

U.S. PATENT DOCUMENTS

| | | | |
|---|---|---|---|
| 2,695,232 | 11/1954 | Richter . | |
| 2,985,306 | 5/1961 | Statzell | 210/340 |
| 3,074,560 | 1/1963 | Kinney | 210/333.1 |
| 3,635,348 | 1/1972 | Carr | 210/333.1 |
| 3,734,299 | 5/1973 | Akiyama | 210/333.1 |
| 3,741,248 | 6/1973 | Stevens, Jr. | 137/607 |
| 3,784,016 | 1/1974 | Akiyama | 210/333.1 |
| 4,169,491 | 10/1979 | Bajka | 137/876 |
| 4,430,220 | 2/1984 | Litzenburger | 210/340 |
| 4,693,785 | 9/1987 | Laakso . | |
| 4,755,290 | 7/1988 | Neuman et al. | 210/333.1 |
| 5,200,077 | 4/1993 | McNeice et al. | 210/333.1 |
| 5,516,426 | 5/1996 | Hull et al. | 210/333.1 |

FOREIGN PATENT DOCUMENTS

| | | |
|---|---|---|
| WO A1 9411565 | 5/1994 | WIPO . |

*Primary Examiner*—Robert Popovics
*Attorney, Agent, or Firm*—Fasth Law Firm; Rolf Fasth

[57] ABSTRACT

The invention relates to a valve arrangement which can preferably be used in connection with a removal system comprising digester screens for digester liquids in cellulose digesters. The valve is characterized by a housing (1) with inlet openings (7) for digester liquid from each screen and at least one outlet opening (5) for the digester liquid from the screens and also at least one inlet opening (8) for digester liquid intended for back-flushing the screens and a rotor (10) in the housing (1) which is designed to shut off intermittently at least one of the inlet openings (7) from the screens and instead open the latter for the liquid for back-flushing.

14 Claims, 3 Drawing Sheets

MULTIPLE INLET VALVE WITH MEANS TO ISOLATE EACH INLET INDIVIDUALLY AND DIRECT A REVERSE FLOW THERETHROUGH

PRIOR APPLICATION

This is a PCT/SE95/00062 filed on 24 Jan., 1995.

TECHNICAL FIELD

The present invention relates to a valve arrangement for use preferably in a removal system which includes digester screens for digester liquids in cellulose digesters. The valve arrangement can of course also be used in other connections where it is desired intermittently to change the flow direction in the inflow lines to the valve.

STATE OF THE ART

Valves of different types are arranged in all flow systems for liquids. The valves may be intended for throttling the liquid flow, shutting off the same or for changing the flow direction. In connection with, for example, cellulose digesting, there is a sophisticated pipe system including valves for removing liquid from the digester and for supplying the same or new liquid to the digester at another place. This pipe system is extensive and a large number of valves is required in this system for adequate regulation of the liquid flows. The result of digesting itself is greatly dependent on these liquid flows being correct and having the correct temperature. The liquid which is removed and brought back to the digester therefore usually passes through a heat exchanger which gives the correct temperature.

The cellulose digester, which preferably consists of an upright closed cylinder, is designed for a high pressure, for example 9 bar. It is very tall, today in most cases approximately 60 meters, and is at given levels, at least two, provided with screen arrangements for removing digesting liquid. The screens in each screen arrangement are arranged as a girdle around the entire digester and may, for example, number 24 in one girdle. Such screens and removal systems for digesting liquid are described in greater detail in, for example, the American patents 2 695 232 and 4 693 785 and also PCT SE9300311.

TECHNICAL PROBLEM

When a liquid containing solid particles of a given size passes through a screen, the solid particles remain on the front side of the screen while the liquid goes through. Gradually, a great quantity of such particles, for example cellulose in a cellulose digester, can be accumulated on the screen and there has a tendency to stop up the screen so that the liquid flow through the latter decreases or stops. It is therefore necessary to remove this solid material so that the screen is not stopped up or plugged, which normally, in a continuous pulp digester, takes place with the aid of the continuous movement of the chip/pulp plug down through the digester. According to the two above-mentioned American patents, the screens were therefore shut off at one time so that the pulp which lies on top of them is guided further down into the digester, by means of the plug which is formed in the digester. According to U.S. Pat. No. 4,693,785, which reveals a valve with a rotor which determines from which of the many inlet openings removal is to take place, the removal can be made to take place asymmetrically. The incoming digesting liquid is in this case supplied centrally into the cylindrical digester and the flow from the central mouth therefore remains unsymmetrical and can be changed throughout the course of events, which is intended to keep the screen surfaces clean.

Subsequently, the trend was towards using back-flushing in order to keep the screens clean. Another trend is to digest the pulp to a much lower kappa number in the digester, which means that more sizing agents are digested out of the chips, which in turn means that the fibre plug down in the digester becomes more homogeneous and suspension-like. A suspension-like fibre pulp has a. stronger tendency than chips to stop up a screen. This problem is especially accentuated if use is made of the ITC® digesting method developed by Kvaerner Pulping, in which the pulp is digested to a very low kappa number at: essentially the same temperature level in all the digesting zones of the digester. This method is described in greater detail in our own application SE 9203462 which also indicates that use must be made of relatively small screen units in order to be able to keep them clean with the aid of back-flushing.

PCT SE9300311 accordingly describes the screen units themselves which we developed in order to be able to carry out effective ITC® digesting. Also described in detail is the procedure when back-flushing is carried out, that is to say when the direction of flow in the removal pipes is changed intermittently, which means that, when the direction of flow has been changed, liquid is pressed into the screen from outside and flushes it clean of solid substances on the inside. This back-flushing takes place during a relatively short time of the operation, calculated in time as approximately 8% of the entire operating time.

In order that it is possible for back-flushing to take place with the systems of today, it is necessary to arrange a large number of valves in the pipe systems. For each screen unit, which is individually sealed, there must be at least two valves which can on the one hand shut off the screen from the removal system and on the other hand lead back-flushing liquid back to the digester. For a normal screen girdle comprising 24 screens, this means 48 valves. These valves are of relatively complicated design and therefore expensive, not least with regard to maintenance.

SOLUTION

It has therefore long been desirable to be able to modify the removal and back-flushing system for inter alia cellulose digesters so that it is possible to use fewer valves in the system and therefore, according to the present invention, a valve arrangement has been produced for use in a removal system comprising screens, preferably digester screens for removing digesting liquid from a cellulose digester, comprising a housing with inlet openings for removal liquid, each inlet opening being connected to a limited number of screens, at least one outlet opening for the removal liquid from the screens and a rotor in the housing, which is characterized by at least one inlet opening for liquid intended for back-flushing of the screens, the rotor being designed to shut off intermittently at least one of the inlet openings from said outlet opening and instead open the latter for communication with said inlet opening for back-flushing.

According to the invention, the housing is internally rotationally symmetrical with the inlet openings for communication with the screens arranged in the rotationally symmetrical wall, possibly with a lining, and it comprises a bottom part with the outlet opening for liquid from the screens and a cover with the inlet opening for the back-flushing liquid, the rotor having a rotationally symmetrical part with a diameter which is smaller than that of the wall 2, possibly with a lining, but comprises an upper rotationally symmetrical edge part which reaches out to the wall 2, possibly with a lining, and divides the housing into two parts above the inlet openings, and also comprises, extending downwards from the upper edge part, at least one part for sealing against the wall of the housing comprising an upwardly open slot.

According to the invention, the width of the slot should be approximately the same size as the diameter or the width in the inlet openings.

Furthermore, the sealing part on either side of the slot should have a width which is approximately equal to the diameter or the width in the inlet openings.

According to the invention, it is appropriate that the inlet openings for removal liquid from the screens are 8 in number.

According to the invention, the slot in the rotor should extend down to the lower edge of the inlet openings.

The rotor according to the invention is intended to be driven intermittently or continuously at a speed of, for example, one revolution per minute.

According to the invention, the rotor can be driven by an electric or hydraulic motor.

According to the invention, the rotor is to make a short stop of, for example, 4 seconds when the slot is situated right in front of an inlet opening for the digester liquid and opens for the back-flushing liquid. The back-flushing flow can be brought about in different ways, for example by means of a pressure tank, but preferably by direct pumping. The removal flow can also be brought about by means of pumping, but also by opening a connection to atmospheric pressure, that is to say by connecting to a so-called flash tank.

After back-flushing, the rotor makes a stop in the sealed position.

DESCRIPTION OF THE FIGURES

The invention will be described below in greater detail with reference to the attached drawings, in which.

PREFERRED EMBODIMENT

Figure 1:
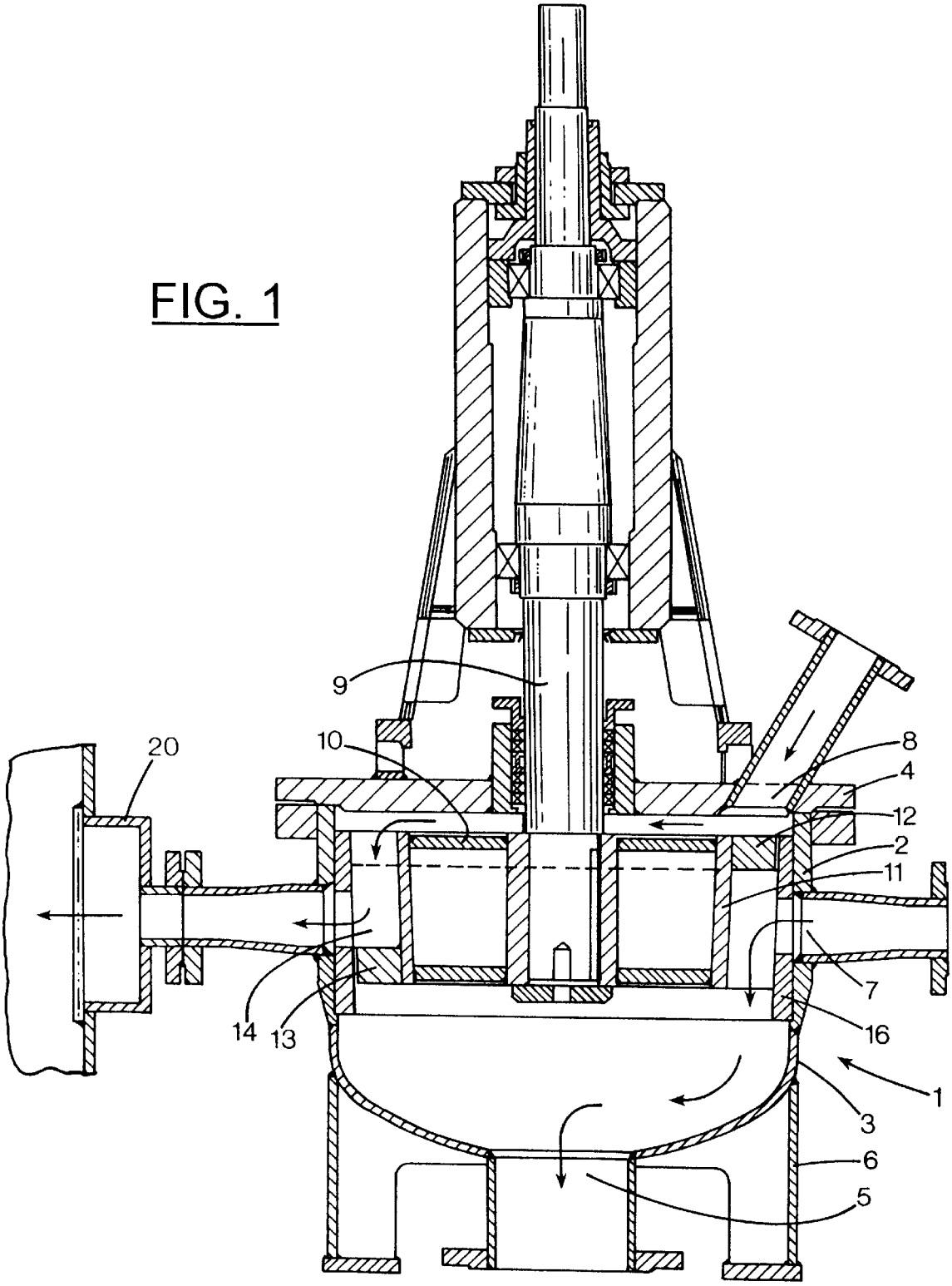
FIG. 1 shows in vertical section a valve arrangement according to the invention.

FIG. 1 shows in vertical section a valve arrangement according to the invention with a housing which is generally designated with 1, which housing has a wall 2 which is rotationally symmetrical on the inside or provided with a rotationally symmetrical lining 16, a bottom part 3 and a cover 4. The bottom part 3 is cup-shaped, but it can also be plane or conical and comprises in its lowest part the outlet opening 5 for removed digester liquid. Welded firmly on the bottom part 3 is a bracket 6 for mounting the valve.

Figure 4:
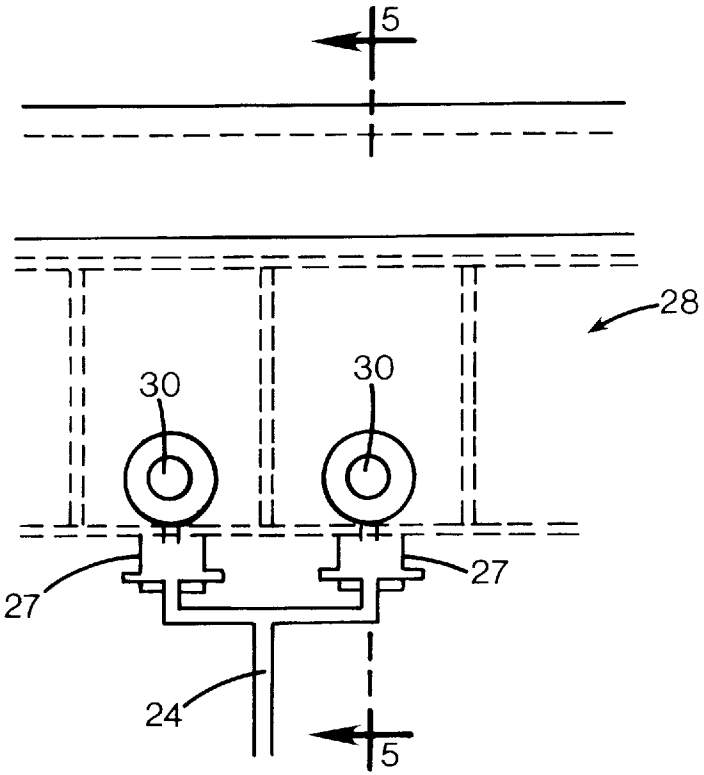
FIG. 4 is a top view of a digester showing the screens disposed therein.
Figure 5:
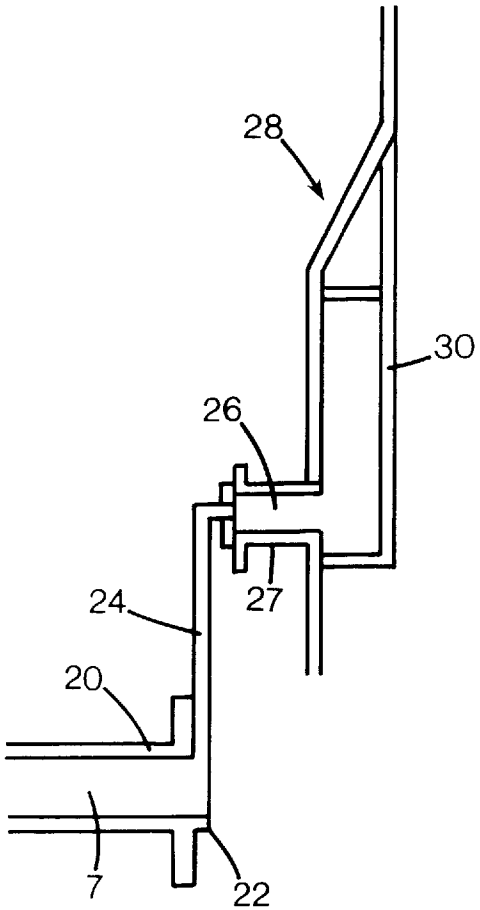
FIG. 5 is a side view of the digester along line A—A of FIG. 4.

Arranged in the wall 2 of the housing 1 are inlet openings 7 for removed digesting liquid. The inlet openings 7 are defined by elongate hollow members 20 that extend radially outwardly from the housing 1. A tube 24 has one end attached to an outer end 22 of the hollow member and the other end of the tube 24 is attached to an inlet opening 26 defined by an inlet portion 27 of a digester 28. Screens, such as digester screens 30, are disposed inside the digester 28. As best shown in FIG. 4, the tube 24 may be connected to a plurality of screens 30. Appropriately, these openings can be eight in number and they can each be connected to their own screen 20 or to a number of screens at once.

Situated in the cover 4 is an opening 8 for inflow of digesting liquid intended for back-flushing. The inlet 8 is shown in the cover itself but it is also possible, if so desired, to arrange this in the upper part of the wall 2 in the housing 1. It should be enough with only one inlet opening 8 for back-flushing liquid but, if so required, a number of such inlets can of course be arranged.

Figure 2:
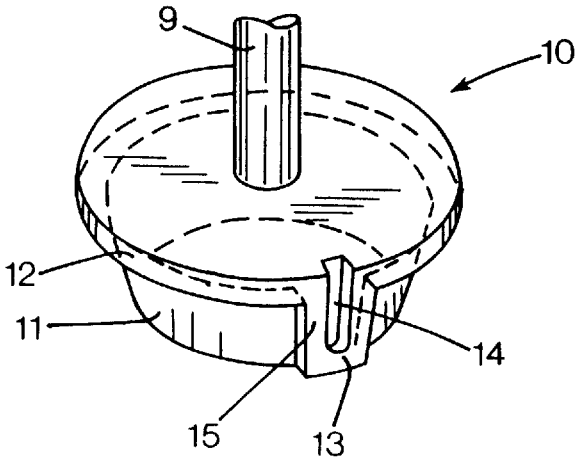
FIG. 2 shows the rotor in the valve arrangement in perspective.

Running centrally through the cover 4 is a rotatable shaft 9 which is mounted and sealed in relation to the space of the housing 1 in a conventional manner. Fixed on this rotatable shaft at its end, preferably with the aid of screw and wedge, is a rotor 10. This rotor 10, which is shown separately and in perspective in FIG. 2, comprises a lower rotationally symmetrical part 11 with a smaller diameter than the diameter of the lining 16 in the wall 2 and thus does not reach out to the latter, and an upper circular edge part 12 with approximately the same diameter as the diameter of the lining 16. The edge part 12 will therefore, with a given small clearance, reach out to the lining 16 and will thus divide the space in the housing 1 into two parts since the rotor 10 with the edge part 12 is arranged at a given distance from the cover 4. Since the lower rotationally symmetrical part 11 on the rotor 10 has a smaller diameter than the lining 16 or the wall 2, this part 11 will not reach out: to the lining 16, which means that this part 11 does not prevent the liquid from the screens flowing through the inlet openings 7 and down into the outlet opening 5 as the arrows show.

Extending from the edge part 12 on the rotor 10 and along the rotationally symmetrical part 11 on the rotor 10 is a sealing part 13 with walls 15 downwards. This part 13, which has virtually the same centre distance as the edge part 12, will, with a given clearance, virtually bear against the conical lining 16. Situated in the sealing part 13 is a slot 14 which is open at the top and delimited at the bottom by a surface at the same height as or below the lower part of the openings 7. When the slot 14 is situated right in front of an opening 7, back-flushing liquid can thus flow from the inlet opening 8 via the top side of the rotor 10 and down through the slot 14 and out again through a former inlet opening 7 for removal liquid, but now in the opposite direction. A pump, not shown, produces the pressure which is necessary for this back-flow.

The rotor 10 is intended to rotate in a stepped manner. It stops when the slot 14 is situated right in front of an inlet opening 7 and remains in this stationary position for sufficient time for back-flushing of the screen 20 or screens which are flushed just then. At the same time, removal of liquid from remaining screens takes place continuously through remaining inlet openings 7. An appropriate time for this back-flushing is four seconds. The rotor then rotates until the slot 14 again arrives right in front of another inlet opening 7 and so on. An appropriate speed of rotation is approximately 1 revolution per minute. The drive of the rotor can appropriately take place with the aid of an. electric step motor or a hydraulic motor or with a continuously operating motor.

Figure 3:
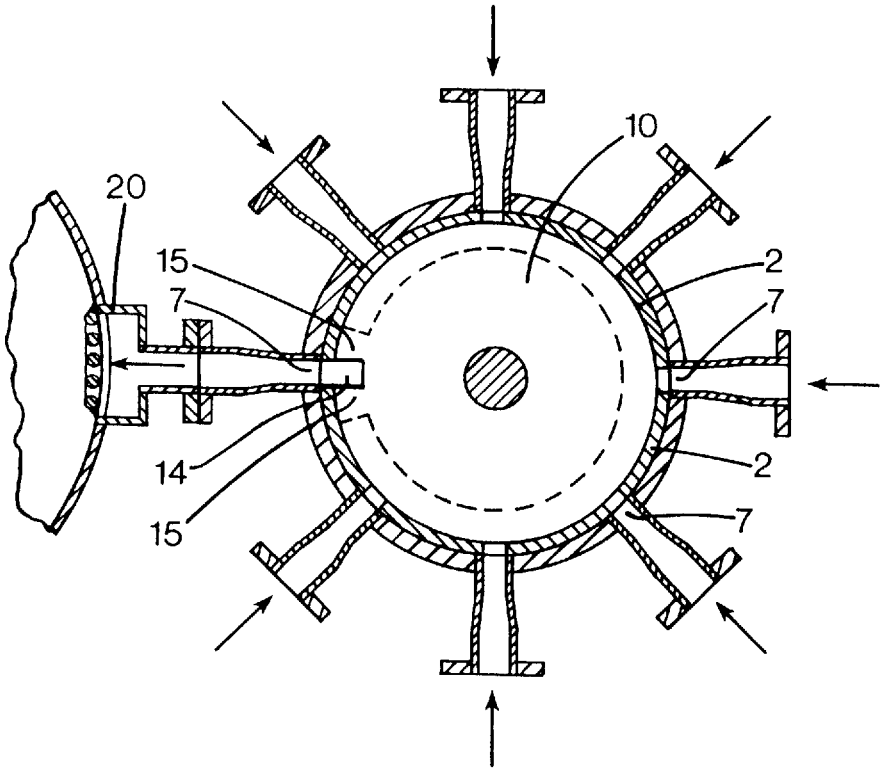
FIG. 3 shows a horizontal section of the valve arrangement at the level of the inlet openings for the digesting liquid.

FIG. 3, which is a horizontal section through the level of the inlet openings 7, shows eight inlet openings 7. There may of course be more or fewer of these. With this number of inlet openings 7, the rotor 10 rotates 13.1° after back-flushing as the duct is to be at rest between back-flushing and removal. Subsequently, it rotates 9.4° when all ducts are in removal mode. After a further 22.5°, the next duct back-flushes. When it stops in front of one of the inlet openings 7 and thus brings about back-flushing, all the other inlet openings 7 function as inlet openings for the removed liquid.

The walls 15 in the sealing part 13 adjacent to the slot 14 should have a width which is equal to the width of the slot. If this is the case, the outlet from the slot 14 will be completely closed before the inlet opening 7, which functioned as an outlet opening when the slot was right in front of it, again functions as an inlet opening for removal liquid. In the same manner, the inlet for removal liquid will on the next stop be completely closed before back-flushing liquid is turned on. It is appropriate that the width of the slot is approximately the same size as the diameter in the inlet openings. The openings are usually bored and round but, if so desired, they can of course also be slot-shaped. The lower part of the slot should be on a level with or below the lower part of the inlet opening 7.

As is evident from the above, the valve arrangement according to the present invention can be used as both a removal and back-flushing valve. By these means, the entire pipe system is simplified and the number of valves can be more than halved. This of course means a great financial advantage with regard to both investment and maintenance while the same removal and back-flushing method as previously is retained.

The invention has been described in association with removal and back-flushing of digester liquids for cellulose digesters but it can of course be used for other similar processes in which it is necessary that the flow direction in a pipe is intermittently reversed. The preferred embodiment as above has been described as a vertically standing valve with a bottom part on the underside. The valve can of course be arranged horizontally or even upside down in relation to what is described above. Only one outlet opening for liquid from the valve has been indicated, but it is of course possible to arrange a number of these, should this be necessary. The outside of the rotor and the inside of the lining are conical. The rotor is also axially displaceable for adjustment of appropriate clearance.

The invention is thus not limited to the embodiment described above but can be modified in various ways within the scope of the patent claims.

We claim:

1. A valve arrangement for use in a removal system for removal of digesting liquid from a cellulose digester, comprising:

a housing having at least three first inlet openings defined therein for removing liquid flowing therethrough;

a plurality of screens in fluid communication with the first inlet openings;

an elongate rotatable rotor disposed in the housing, the rotatable rotor being substantially perpendicular to the first inlet openings;

the housing defining an outlet opening for removing liquid from the screens;

the housing defining a second inlet opening adapted to back flush the screens with a back flushing liquid; and the rotor being adapted to intermittently shut off the first inlet openings from the outlet opening and opening a fluid communication between the first inlet openings and the second inlet opening to permit back flushing of the screens, the first inlet openings being disposed between the second inlet opening and the screens so that the back flushing liquid is permitted to pass through the first inlet openings before the back flushing liquid is permitted to pass through the screens.

2. The valve arrangement according to claim 1 wherein the housing comprises a bottom part defining the outlet opening and a cover defining the second inlet opening for carrying back flushing liquid into the housing, the rotor having a rotationally symmetrical part having an outer diameter that is smaller than an inner diameter of an inner wall of the housing, the rotor comprises an upper rotationally symmetrical edge portion attached to the symmetrical part, the upper rotationally symmetrical edge portion extending radially outwardly to the inner wall of the housing to divide the housing into two sections, the rotor comprises a lower edge portion that sealingly extends to the inner wall, the lower edge portion has an upward slot defined therein.

3. The valve arrangement according to claim 2 wherein the lower edge portion has a body portion surrounding the slot, the body portion has a width that is equivalent to an inner diameter of the first inlet opening.

4. The valve arrangement according to claim 1 wherein the housing defines eight first inlet openings.

5. The valve arrangement according to claim 2 wherein the first inlet opening has a lower edge and the slot extends to the lower edge of the first inlet opening.

6. The valve arrangement according to claim 1 wherein the rotor is adapted to be driven intermittently or continuously at a speed of about one revolution per minute.

7. The valve arrangement according to claim 1 wherein the rotor is driven by an electric motor.

8. The valve arrangement according to claim 1 wherein the rotor is driven by a hydraulic motor.

9. The valve arrangement according to claim 2 wherein the rotor is adapted to stop for about four seconds when the slot is aligned with the first inlet opening to back flush the screens.

10. The valve arrangement according to claim 9 wherein the rotor is adapted to stop in a sealed position when the screens are back flushed by liquid.

11. A valve arrangement for use in a removal system having screens for removal of digesting liquid from a cellulose digester, comprising:

a housing having at least three first inlet openings defined therein for removing liquid flowing therethrough;

a plurality of screens in fluid communication with the first inlet openings;

a rotatable rotor disposed in the housing, the rotor having a rotationally symmetrical part having an outer diameter that is smaller than an inner diameter of an inner wall of the housing, the rotor comprising an upper rotationally symmetrical edge portion attached to the symmetrical part, the upper rotationally symmetrical edge portion extending radially outwardly to the inner wall of the housing to divide the housing into two sections, the rotor comprising a lower edge portion that sealingly extends to the inner wall, the lower edge portion having an upward slot defined therein, the lower edge portion having a body portion surrounding the slot, the body portion having a width that is equivalent to an inner diameter of the first inlet opening;

the housing defining an outlet opening for removing liquid from the screens;

the housing defining a second inlet opening adapted to back flush the screens, the housing comprises a bottom part defining the outlet opening and a cover defining the second inlet opening for carrying back flushing liquid into the housing; and the rotor being adapted to intermittently shut off the first inlet opening from the outlet opening and opening a fluid communication between the first inlet opening and the second inlet opening to permit back flushing of the screens, the rotor being adapted to stop for about four seconds in a sealed position when the slot is aligned with one of the first inlet openings to back flush the screens.

12. A valve arrangement according to claim 11 wherein the slot is elongate and the rotor includes a shaft that is substantially parallel to the slot.

13. A valve arrangement according to claim 12 wherein the slot has an open upper end and a closed lower end.

14. A valve arrangement for use in a removal system for removal of digesting liquid from a cellulose digester, comprising:

a housing having at least three first inlet openings defined therein for removing liquid flowing therethrough;

an elongate rotatable rotor disposed in the housing, the rotor having a slot defined therein, the rotor being substantially perpendicular to the first inlet openings;

the housing defining an outlet opening for removing liquid from the first inlet openings;

the housing defining a second inlet opening adapted to back flush a back flushing liquid through the slot of the rotatable rotor and into at least one of the first inlet openings; and the rotatable rotor being adapted to intermittently shut off the first inlet openings from the outlet opening and opening a fluid communication between the first inlet openings and the second inlet opening to permit the back flushing liquid to pass through the slot of the rotatable rotor into the first inlet openings when the slot of the rotatable rotor is disposed immediately adjacent the first inlet openings.

* * * * *